US010235981B2

(12) United States Patent
Vilermo et al.

(10) Patent No.: US 10,235,981 B2
(45) Date of Patent: Mar. 19, 2019

(54) INTELLIGENT CROSSFADE WITH SEPARATED INSTRUMENT TRACKS

(71) Applicant: Nokia Technologies Oy, Espoo (FI)

(72) Inventors: Miikka Tapani Vilermo, Siuro (FI); Arto Juhani Lehtiniemi, Lempaala (FI); Lasse Juhani Laaksonen, Nokia (FI); Mikko Tapio Tammi, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 15/990,960

(22) Filed: May 29, 2018

(65) Prior Publication Data

US 2018/0277076 A1 Sep. 27, 2018

Related U.S. Application Data

(63) Continuation of application No. 15/198,499, filed on Jun. 30, 2016, now Pat. No. 10,002,596.

(51) Int. Cl.

| | |
|---|---|
| ***G10H 1/00*** | (2006.01) |
| ***G10H 1/46*** | (2006.01) |
| ***H04H 60/04*** | (2008.01) |

(52) U.S. Cl.

CPC ..... *G10H 1/0008* (2013.01); *G10H 1/46* (2013.01); *H04H 60/04* (2013.01);

(Continued)

(58) Field of Classification Search

CPC ..... G10H 2210/056; G10H 2210/076; G10H 2210/125; H04H 60/04

(Continued)

(56) References Cited

U.S. PATENT DOCUMENTS 3,559,180 A * 1/1971 Joly ..... H03M 1/1205 341/139
5,803,747 A * 9/1998 Sone ..... G10H 1/368 348/589

(Continued)

FOREIGN PATENT DOCUMENTS

GB 2506404 A * 4/2014 ..... G11B 27/038
GB 2533654 A 6/2016

OTHER PUBLICATIONS

"Beyond Beatmatching Control the Energy Level (how to DJ)", http://www.mixedinkey.com/Book/Control-the-Energy-Level-of-Your-DJ-Sets; May 20, 2016, 7 pgs.

(Continued)

*Primary Examiner* — David Warren
*Assistant Examiner* — Christina Schreiber
(74) *Attorney, Agent, or Firm* — Harrington & Smith

(57) ABSTRACT

A method is provided including separating a first file into a first plurality of instrument tracks and a second file into a second plurality of instrument tracks, wherein each instrument track of each of the first plurality and second plurality corresponds to a type of instrument; selecting a first instrument track from the first plurality of instrument tracks and a second instrument track from the second plurality of instrument tracks based at least on the type of instrument corresponding to the first instrument track and the second instrument track; fading out other instrument tracks from the first plurality of instrument tracks; performing a crossfade between the first instrument track and the second instrument track; and fading in other instrument tracks from the second plurality of instrument tracks.

20 Claims, 6 Drawing Sheets

(52) U.S. Cl.
CPC . *G10H 2210/036* (2013.01); *G10H 2210/056* (2013.01); *G10H 2210/076* (2013.01); *G10H 2210/125* (2013.01); *G10H 2250/035* (2013.01)

(58) Field of Classification Search
USPC ..... 84/609
See application file for complete search history.

(56) References Cited

U.S. PATENT DOCUMENTS 5,952,596 A * 9/1999 Kondo ..... G10H 1/20 84/605
6,933,432 B2 * 8/2005 Shteyn ..... G10H 1/0033 84/609
7,019,205 B1 * 3/2006 Fujisawa ..... A63F 13/10 84/609
7,518,053 B1 * 4/2009 Jochelson ..... G10H 1/40 84/603
7,732,697 B1 * 6/2010 Wieder ..... G10H 1/0025 84/609
7,915,514 B1 * 3/2011 Shrem ..... G10H 1/0075 84/615
8,280,539 B2 * 10/2012 Jehan ..... G11B 27/322 381/81
8,319,087 B2 11/2012 Gossweiler et al. ..... 84/600
8,487,176 B1 * 7/2013 Wieder ..... G10H 1/0025 84/615
8,874,245 B2 * 10/2014 Reinsch ..... G06F 17/00 700/94
9,070,352 B1 * 6/2015 Yang ..... G10H 1/08
2002/0157522 A1 * 10/2002 Cliff ..... G10H 7/008 84/625
2002/0172379 A1 * 11/2002 Cliff ..... G11B 27/002 381/119
2003/0188625 A1 * 10/2003 Tucmandl ..... G10H 1/0025 84/609
2004/0254660 A1 * 12/2004 Seefeldt ..... G10H 1/40 700/94
2009/0019994 A1 * 1/2009 McKinney ..... G10H 1/40 84/612
2011/0011246 A1 * 1/2011 Buskies ..... G10H 1/0066 84/613
2011/0015767 A1 * 1/2011 Homburg ..... G10H 1/0066 700/94
2012/0014673 A1 * 1/2012 O'Dwyer ..... G06F 3/0346 386/282
2013/0290818 A1 * 10/2013 Arrasvuori ..... H04N 21/4383 715/201
2014/0076125 A1 * 3/2014 Kellett ..... G10H 7/00 84/609
2014/0083279 A1 * 3/2014 Little ..... G10H 1/0008 84/609
2014/0254831 A1 * 9/2014 Patton ..... H03G 3/20 381/107
2014/0270181 A1 * 9/2014 Siciliano ..... G11B 27/038 381/17
2014/0355789 A1 * 12/2014 Bohrarper ..... H04R 3/00 381/119
2016/0086368 A1 * 3/2016 Laaksonen ..... G06T 13/80 345/473
2016/0224310 A1 * 8/2016 Wallner ..... G11B 27/034
2016/0372096 A1 * 12/2016 Lyske ..... G10H 1/40
2017/0056772 A1 * 3/2017 Eng ..... A63F 13/54
2017/0098439 A1 * 4/2017 Kojima ..... G10H 7/008
2017/0148425 A1 * 5/2017 Fraga ..... H03G 3/20
2017/0301372 A1 * 10/2017 Jehan ..... G11B 27/038

OTHER PUBLICATIONS

Spatial Audio Object Coding, http://mpeg.chiariglione.org/standards/mpeg-d/spatial-audio-obiect-coding; Apr. 2008, 2 pgs.
Rickard, Scott, "The DUET Blind Source Separation Algorithm", In S. Makino T.-W. Lee, & H. Sawada (Eds.), Blind Speech Separation, Dordrecht, Netherland: Springer, pp. 217-241, Nov. 2017.
Eronen, Antti, "Automatic Musical Instrument Recognition, Master of Science Thesis", Tampere University of Technology, Oct. 2001, 74 pgs.
Nakagawa, Sei-ichi, "Spoken Sentence Recognition by Time-Synchronous Parsing Algorithm of Context-Free Grammar", IEEE 1987, pp. 829-832.
Klapuri, Anssi P., et al., "Analysis of the Meter of Acoustic Musical Signals", IEEE Transactions on Audio, Speech, and Language Processing, vol. 14, No. 1, pp. 342-355, Jan. 2006.
Peelers, Geoffroy, "Musical Key Estimation of Audio Signal Based on Hidden Markov Modeling of Chroma Vectors", Proc. Of the 9th Int. Conf. On Digital Audio Effects (DAFx-06), Montreal, Canada, pp. 127-131, Sep. 2006.
Goto, Masataka, "Acoustical-similarity-based Musical Instrument Hierarchy and Its Application to Musical Instrument Identification", Proceedings of the International Symposium on Musical Acoustics, Mar.-Apr. 2004, pp. 297-300.
Falch, Cornelia, et al., "Spatial Audio-Object Coding With Enhanced Audio Object Separation", Proc. of the 13th Int. Conference on Digital Audio Effects (DAFS-10), Sep. 2010, 7 pgs.

* cited by examiner

INTELLIGENT CROSSFADE WITH SEPARATED INSTRUMENT TRACKS

CROSS-REFERENCE TO RELATED APPLICATIONS

The present application claims the benefit of U.S. application Ser. No. 15/198,499, filed on Jun. 30, 2016, the disclosure of which is hereby incorporated by reference in its entirety.

TECHNICAL FIELD

This invention relates generally to audio mixing techniques and, more specifically, relates to intelligent audio crossfading.

BACKGROUND

This section is intended to provide a background or context to the invention disclosed below. The description herein may include concepts that could be pursued, but are not necessarily ones that have been previously conceived, implemented or described. Therefore, unless otherwise explicitly indicated herein, what is described in this section is not prior art to the description in this application and is not admitted to be prior art by inclusion in this section.

Crossfading is an audio mixing technique that involves fading a first audio source out while fading a second audio source in at the same time. Simple crossfading does not work well when different types of songs (e.g. different genres, tempo, instrumentation, etc.) are crossfaded. Manual crossfading by DJs can be performed more intelligently, however even in this case crossfading is limited as typical song formats are not separated into instrument tracks. Newer music formats, such as MPEG Spatial Audio Object Coding (SAOC), that deliver partially separated tracks to the consumer. Additionally, newer methods such as blind source separation (BSS) allow instrument tracks to be separated from a mix such as that found in typical music files.

SUMMARY

The following summary is merely intended to be exemplary. The summary is not intended to limit the scope of the claims.

In accordance with one aspect, a method includes: separating a first file into a first plurality of instrument tracks and a second file into a second plurality of instrument tracks, wherein each instrument track of each of the first plurality and second plurality corresponds to a type of instrument; selecting a first instrument track from the first plurality of instrument tracks and a second instrument track from the second plurality of instrument tracks based at least on the type of instrument corresponding to the first instrument track and the second instrument track; fading out other instrument tracks from the first plurality of instrument tracks; performing a crossfade between the first instrument track and the second instrument track; and fading in other instrument tracks from the second plurality of instrument tracks.

In accordance with another aspect, an apparatus includes at least one processor; and at least one memory including computer program code, the at least one memory and the computer program code configured, with the at least one processor, to cause the apparatus to perform at least the following: separate a first file into a first plurality of instrument tracks and a second file into a second plurality of instrument tracks, wherein each of the respective instrument tracks correspond to a type of instrument; select a first instrument track from the first plurality of instrument tracks and a second instrument track from the second plurality of instrument tracks based at least on the type of instrument corresponding to the first instrument track and the second instrument track; crossfade between the first instrument track and the second instrument track; and fade in the other instrument tracks from the second plurality of instrument tracks.

In accordance with another aspect, a computer program product includes a non-transitory computer-readable storage medium having computer program code embodied thereon which when executed by an apparatus causes the apparatus to perform: separating a first file into a first plurality of instrument tracks and a second file into a second plurality of instrument tracks, wherein each instrument track of each of the first plurality and second plurality corresponds to a type of instrument; selecting a first instrument track from the first plurality of instrument tracks and a second instrument track from the second plurality of instrument tracks based at least on the type of instrument corresponding to the first instrument track and the second instrument track; fading out other instrument tracks from the first plurality of instrument tracks; performing a crossfade between the first instrument track and the second instrument track; and fading in other instrument tracks from the second plurality of instrument tracks.

BRIEF DESCRIPTION OF THE DRAWINGS

The foregoing aspects and other features are explained in the following description, taken in connection with the accompanying drawings, wherein.

DETAILED DESCRIPTION

The word "exemplary" is used herein to mean "serving as an example, instance, or illustration." Any embodiment described herein as "exemplary" is not necessarily to be construed as preferred or advantageous over other embodiments. All of the embodiments described in this Detailed Description are exemplary embodiments provided to enable persons skilled in the art to make or use the invention and not to limit the scope of the invention which is defined by the claims.

Figure 1:
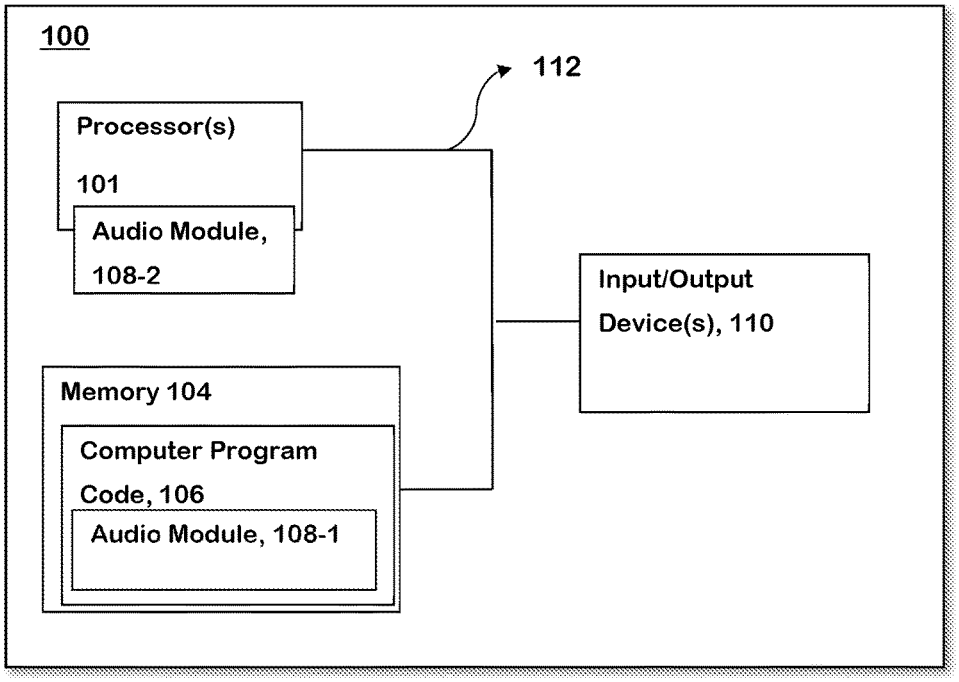
FIG. 1 is a block diagram of one possible and non-limiting exemplary apparatus in which the exemplary embodiments may be practiced.

Referring to FIG. 1, this figure shows a block diagram of one possible and non-limiting exemplary apparatus in which the exemplary embodiments may be practiced. Although the features will be described with reference to the example embodiments shown in the drawings, it should be understood that features can be embodied in many alternate forms of embodiments. In addition, any suitable size, shape, or type of elements or materials could be used.

In FIG. 1, an apparatus 100 is shown. The apparatus 100 includes one or more processors 101, one or more memories 104 interconnected through one or more buses 112. The one or more buses 112 may be address, data, or control buses, and may include any interconnection mechanism, such as a series of lines on a motherboard or integrated circuit, fiber optics or other optical communication equipment, and the like. The one or more memories 104 include computer program code 106. The apparatus 100 includes am audio module, comprising one of or both parts 108-1 and/or 108-2, which may be implemented in a number of ways. The audio module may be implemented in hardware as audio module 108-2, such as being implemented as part of the one or more processors 101. The audio module 108-2 may be implemented also as an integrated circuit or through other hardware such as a programmable gate array. In another example, the audio module may be implemented as audio module 108-2, which is implemented as computer program code 106 and is executed by the one or more processors 101. For instance, the one or more memories 104 and the computer program code 106 may be configured to, with the one or more processors 101, cause the apparatus 100 to perform one or more of the operations as described herein.

The one or more computer readable memories 104 may be of any type suitable to the local technical environment and may be implemented using any suitable data storage technology, such as semiconductor based memory devices, flash memory, magnetic memory devices and systems, optical memory devices and systems, fixed memory and removable memory. The computer readable memories 104 may be means for performing storage functions. The processor(s) 101 may be of any type suitable to the local technical environment, and may include one or more of general purpose computers, special purpose computers, microprocessors, digital signal processors (DSPs) and processors based on a multi-core processor architecture, as non-limiting examples. The processor(s) 101 may be means for performing functions, such as controlling the apparatus 100 and other functions as described herein.

In some embodiments, the apparatus 100 may include one or more input and/or output devices 110. The input and/or output devices 110 may be any commonly known device for providing user input to a computer system, e.g. a mouse, a keyboard, a touch pad, a camera, a touch screen, and/or a transducer. The input and/or output devices 110 may also be a commonly known display, projector, or a speaker for providing output to a user.

In general, the various embodiments of the apparatus 100 can include, but are not limited to cellular telephones such as smart phones, tablets, personal digital assistants (PDAs), computers such as desktop and portable computers, gaming devices, music storage and playback appliances, tablets, as well as portable units or terminals that incorporate combinations of such functions. As those skilled in the art will understand, embodiments of the invention are also applicable to music applications and services, such as SPOTIFY, PANDORA, YOUTUBE, and the like.

Embodiments of the invention relate to MPEG Spatial Audio Object Coding (SAOC) where partially separated instrument tracks are delivered to the consumer. MPEG SAOC is described in more detail in the following document 111: Spatial Audio Object Coding. April 2008. <http://mpeg.chiariglione.org/standards/mpeg-d/spatial-audio-object-coding>. MPEG SAOC allows otherwise free editing of the separated instrument tracks, but the resulting audio quality may suffer from too drastic changes. Embodiments also relate to blind sound source separation (BSS), where music instrument tracks can be partially separated from a mix such as that found on a CD for example. BSS separated instrument tracks can also be mixed but they too suffer if the mixing is changed too much as compared to the original, i.e., the separation is partial. With SAOC and BSS the separated tracks are not perfect in the sense that, for example, the separated drum track will contain parts of the other instruments (vocals, guitar, etc.). The drum will dominate the separated drum track but the other instruments are also faintly audible there. SAOC does this separation better than BSS, however, the same problem persists there. If you make the crossfade on the separated drum track, the crossfading may cause problems because the crossfading affects these faintly audible other instruments as well as the drum sound on the separated drum track. For example, if during the crossfading the tempo is drastically changed, this might sound ok with the drum sound but might sound bad with the faintly audible other instruments.

The following documents are relevant to at least some of embodiments described herein: document [2]: Rickard, S. (2007). The DUET Blind Source Separation Algorithm. In S. Makino, T.-W. Lee, & H. Sawada (Eds.), *Blind Speech Separation* (pp. 217-241). Dordrecht, Netherlands: Springer); document [3]: Eronen, A. (2001, October). *Automatic Musical Instrument Recognition, Master of Science Thesis.* Tampere, Finland: Tampere University of Technology; document [4]: U.S. Pat. No. 5,952,596 titled *Method of changing tempo and pitch of audio by digital signal processing*, which is herein incorporated by reference in its entirety; document [5]: S. Nakagawa, "Spoken sentence recognition by time-synchronous parsing algorithm of context-free grammar," *Acoustics, Speech, and Signal Processing, IEEE International Conference on ICASSP* '87., 1987, pp. 829-832; document [6]: A. P. Klapuri, A. J. Eronen and J. T. Astola, "Analysis of the meter of acoustic musical signals," in *IEEE Transactions on Audio, Speech, and Language Processing*, vol. 14, no. 1, pp. 342-355, January 2006; document [7]: Antti Eronen et Al.:NC87157 "Methods for analyzing dominance of tags in music"; document [8]: Peeters, Geoffroy, "Musical Key Estimation of Audio Signal Based on Hidden Markov Modeling of Chroma Vectors", Proc. of the 9th Int. Conf. on Digital Audio Effects (DAFx-06), Montreal, Canada, Sep. 18-20, 2006, pp. 127-131; and document [9]: Goto, Masataka, Hiroshi G. Okun and Tetsuro Kitahara. "Acoustical-similarity-based Musical Instrument Hierarchy." *Proceedings of the International Symposium on Musical Acoustics, March* 31*st to April* 3*rd* (2004): 297-300.

In document [2], describes techniques for creating partially separated instrument tracks using BSS from traditional music files. In particular, document [2] provide a DUET Blind Source Separation method which can separate any number of sources using only two mixtures. The method is valid when sources are W-disjoint orthogonal, that is, when the supports of the windowed Fourier transform of the signals in the mixture are disjoint. For anechoic mixtures of attenuated and delayed sources, the method allows one to estimate the mixing parameters by clustering relative attenuation-delay pairs extracted from the ratios of the time-frequency representations of the mixtures. The estimates of the mixing parameters are then used to partition the time-frequency representation of one mixture to recover the original sources. The technique is valid even in the case when the number of sources is larger than the number of mixtures. The method is particularly well suited to speech mixtures because the time-frequency representation of speech is sparse and this leads to W-disjoint orthogonality.

Document [3], describes techniques for recognizing an instrument in each track. Document [3] describes a method where a method which includes pre-processing a signal and transforming the signal into some compact representation that is easier to interpret than the raw waveform. The compact representations may be, for example, LP coefficients, outputs of a mel-filterbank calculated in successive frames, sinusoid envelopes, and a short-time RMSenergy envelope. The method than extracts various characteristic features from the different representations. These representations may contain hundreds or thousands of values calculated at discrete time intervals which are compressed into around 1-50 characteristic features for each note (or for each time interval if using frame-based features). The method then compares the extracted features to a trained model of stored templates to recognize the instrument associated with the signal.

Document [4] provides a method for concurrently changing a tempo and a pitch of an audio signal according to tempo designation information and pitch designation information. An audio signal composed of original amplitude values sequentially is sampled at original sampling points timed by an original sampling rate within an original frame period. The original frame period is converted into an actual frame period by varying a length of the original frame period according to the tempo designation information so as to change the tempo of the audio signal. Each of the original sampling points are converted into each of actual sampling points by shifting each of the original sampling points according to the pitch designation information so as to change the pitch of the audio signal. Each of actual amplitude values are calculated at each of the actual sampling points by interpolating the original amplitude values sampled at original sampling points adjacent to the actual sampling point. The actual amplitude values are sequentially read by the original sampling rate during the actual frame period so as to reproduce a segment of the audio signal within the actual frame period. A series of the segments reproduced by repetition of the actual frame period are smoothly connected to thereby continuously change the tempo and the pitch of the audio signal.

In document [5], describes techniques for recognizing voiced sentences. According to document [5], a method is provided for new continuous speech recognition by phoneme-based word spotting and time-synchronous context-free parsing. The word pattern is composed of the concatenation of phoneme patterns. The knowledge of syntax is given in Backus Normal Form. The method is task-independent in terms of reference patterns and task language. The system first spots word candidates in an input sentence, and then generates a word lattice. The word spotting is performed by a dynamic time warping method. Secondly, the method selects the best word sequences found in the word lattice from all possible sentences which are defined by a context-free grammar.

Document [6] describes techniques for performing musical tempo analysis. According to document [6], a method analyzes the basic pattern of beats in a piece of music, the musical meter. The analysis is performed jointly at three different time scales: at the temporally atomic tatum pulse level, at the tactus pulse level which corresponds to the tempo of a piece, and at the musical measure level. Acoustic signals from arbitrary musical genres are considered. For the initial time-frequency analysis, a technique is proposed which measures the degree of musical accent as a function of time at four different frequency ranges. This is followed by a bank of comb filter resonators which extracts features for estimating the periods and phases of the three pulses. The features are processed by a probabilistic model which represents primitive musical knowledge and uses the low-level observations to perform joint estimation of the tatum, tactus, and measure pulses. The model takes into account the temporal dependencies between successive estimates and enables both causal and noncausal analysis.

Document [7] describes techniques for recognizing a dominant instrument. Different features are calculated from the audio signal. Best features are first selected before fitting the regression model. This is done by using univariate linear regression tests for the regressors. Best features are used for training a model which predicts the dominance of an instrument. A linear regression model is used to predict the dominance on a scale from 0 to 5. The training is done using a hand-annotated database dominances of instruments for a collection of music tracks.

Document [8] describes a system for the automatic estimation of the key of a music track using hidden Markov models is provided. The front-end of the system performs transient/noise reduction, estimation of the tuning and then represents the track as a succession of chroma vectors over time. The characteristics of the Major and minor modes are learned by training two hidden Markov models on a labeled database. 24 hidden Markov models corresponding to the various keys are then derived from the two trained models. The estimation of the key of a music track is then obtained by computing the likelihood of its chroma sequence given each HMM.

Document [9] describes a method of constructing a musical instrument hierarchy reflecting the similarity of acoustical features. The method uses a feature space and approximates the distribution of each instrument using a large number of sounds. Category-level identification of non-registered instruments is performed using this hierarchy.

According to embodiments described herein, crossfading is performed by separating audio files (e.g. audio files comprising a song, or video files) into individual tracks, such as audio tracks for example, and crossfading between the tracks. The process of separating the files into audio tracks is not always perfect, and frequently an individual instrument track will include sound from other instruments. Thus, the separation is merely 'partial' separation. Frequently, the instruments that leak onto an individual instrument track sound similar to individual instrument.

In some example embodiments, crossfading is done using, e.g., information about the dominant instrument of the song. Typically, the dominant instrument separates better than others and thus there are less audible errors from the separation. According to some embodiments, crossfading is performed using a selected instrument that is suitable for the change needed to smoothly change from first song to second song. Similar tracks to the selected instrument track are not faded out during the crossfade because similar tracks tend to leak onto each other and would make the separation errors more audible. According to some embodiments, crossfade is done using based on both the dominant instrument and its similar tracks. These and other embodiments are described in more detail below.

Figure 2:
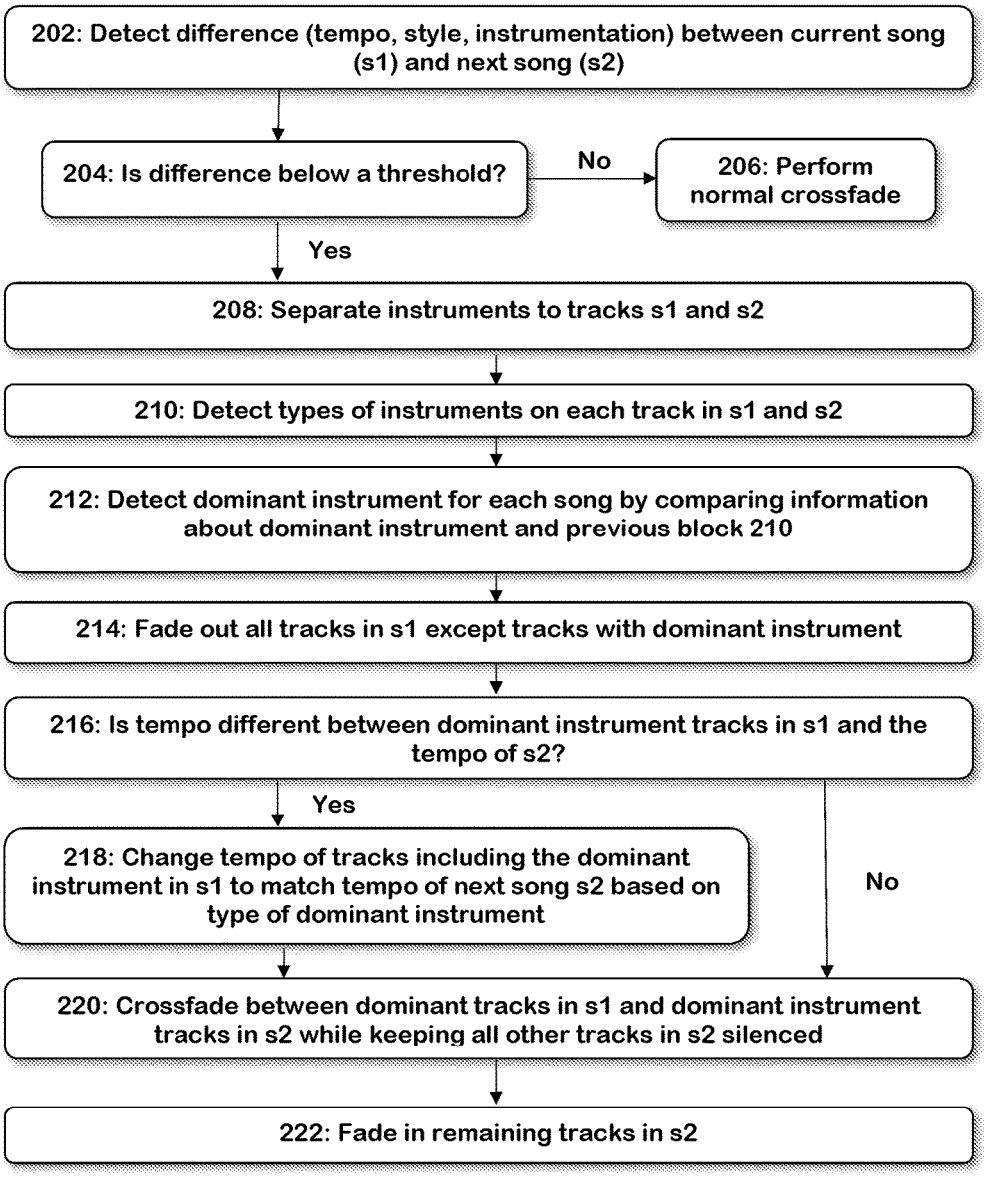
FIG. 2 is a process flow diagram for intelligent crossfading between two songs based on a dominant instrument according to an exemplary embodiment.

Referring now to FIG. 2, this figure is a process flow diagram for intelligent crossfading between two songs (s1, s2) based on a dominant instrument according to an exemplary embodiment. The dominant instrument may be the same dominant instrument for each of the two songs, such as drums for example. However, the dominant instrument may also be a different type of instrument for each of the songs, such as drums and guitar for example. According to this exemplary embodiment, information about a dominant instrument is used to help minimize errors caused by separation during crossfading. This example is described using two songs, however, embodiments are also applicable to other types of files, such as video files for example.

First, at step 202 two songs are analyzed to detect differences between a current song (s1) and a next song (s2), which may be done, e.g., as described in documents [3] and [6]. The difference may include, e.g., a difference in tempo, genre, instrumentation, etc. At step 204, the difference is compared to a threshold value. If the difference is below the threshold value, then a normal crossfade is performed at step 206. If the difference is above the threshold, then the process continues to step 208. At step 208, the two songs are separated into a plurality of audio tracks. In case of traditional audio files, the techniques described in document [3] may be used for example. For MPEG SAOC files, this separation comes automatically based on the file format as each track is its own instrument. At step 210, each of the tracks are analyzed identify at least one instrument on each of the plurality of tracks. Frequently, one instrument will on each track, however, it should be understood that one instrument track may include all percussive instruments (base drum, hi-hat, cymbals etc.), however it should be understood that tracks may include more than one instrument. For example, percussive instruments together considered to be a "single instrument". The instruments may be identified using, for example, the metadata of a MPEG SAOC file (if such metadata is available) or techniques such as those described in document [4]. At step 212, a dominant instrument is detected for each of the songs. An analysis may be performed on the tracks to determine the dominant instrument by known signal processing means (e.g. as described by document [7]). A dominant instrument typically refers to an instrument that is louder than other instrument tracks on the audio file and/or is more continuously present than other instrument tracks. Separating the dominant instrument track is generally easier than separating other instrument tracks because the other instrument tracks do not leak as much to the separated dominant instrument track. At step 214, all instrument tracks from s1 are faded out except for tracks including the dominant instrument. At step 216, the tempo of dominant instrument tracks of s1 is compared to the tempo of s2. If the tempos are the same, then the process continues to step 220, If the tempos are different, then the tempo of the dominant instrument tracks of s1 are changes to match the tempo of s2 as indicated by step 218. Preferably, the tempo is changed is performed gradually. Additionally, the algorithm that performs the tempo changing may be based on the type of dominant instrument in s1. At step 220, crossfading is performed between the dominant instrument tracks in s1, and the dominant instrument tracks in s2 while keeping the other track (i.e. non-dominant instrument tracks) silenced. Finally, at step 222, the non-dominant instrument tracks in s2 are faded in.

The threshold value in step 204 may be based on the differences between the current song (s1) and the next song (s2). For example, if the difference is a difference in tempo then the threshold value may correspond to beats per minute (e.g. 5 bpm for example). If the difference is genre, changing the whole genre (e.g. from rock to pop) may be considered above a threshold whereas changing between sub-genres may be below the threshold (e.g. classical rock to progressive rock). If the difference is instrumentation changing from a marching band to rock band may be above the threshold value; and the difference may be below threshold value, e.g., when switching from rock band A, which includes one singer, two guitars, one drummer, to rock band B which includes one singer, two guitars, one drummer, one keyboard.

When two songs are crossfaded, if there is a tempo difference or other differences between the songs, some manipulation is needed in order to have the crossfade sound right, which is performed in step 220 above. Typically, the manipulation includes tempo manipulation, musical key manipulation, etc. One factor that should be considered, is that certain manipulation algorithms work best for certain types of instrument tracks. For example, some manipulation algorithms work well for harmonic instruments (e.g. a synthesizer, singing) while other manipulation algorithms are better suited for non-harmonic instruments (e.g. drums). Therefore, a single manipulation algorithm typically does not work well for an entire mix because the mix will generally include many kinds of instruments. A second factor is that manipulation algorithms work best when performed on for single instrument tracks. According to some embodiments, it is preferable to do the manipulation during the crossfade for a separated instrument track based on these two factors. As mentioned above, dominant instruments are generally separated best; therefore, embodiments select a manipulation algorithm based on the type of dominant instrument. This ensures that the selected manipulation algorithm is well suited for the dominant instrument.

Figure 3:
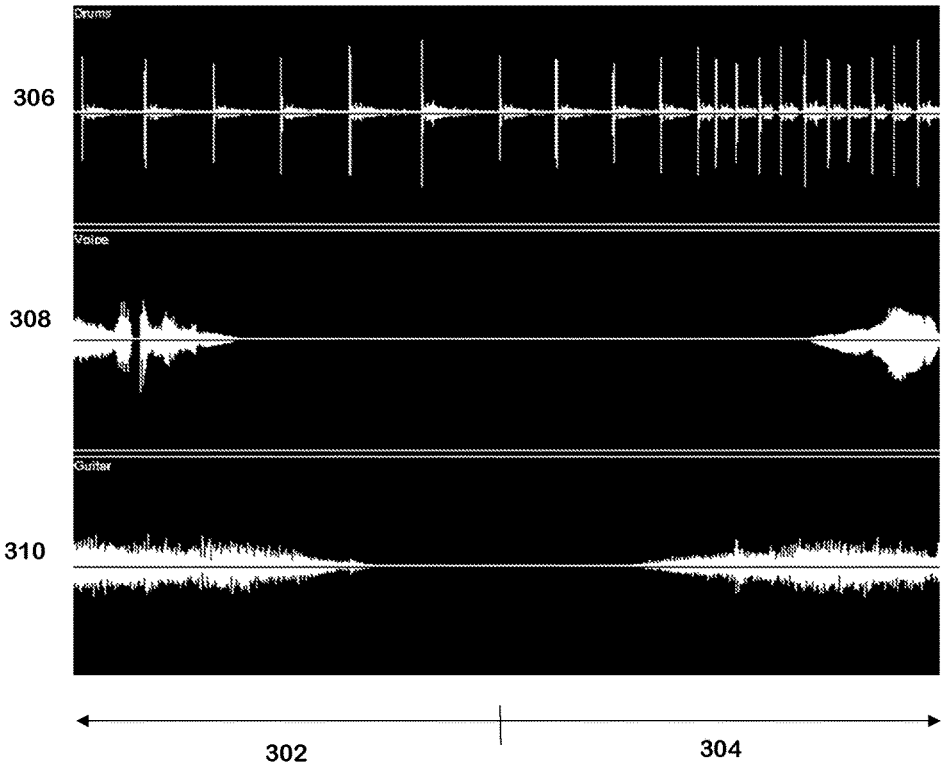
FIG. 3 illustrates an example crossfade with separated tracks for two songs according to an exemplary embodiment.

Referring now to FIG. 3, this figure visually illustrates an example crossfade between two songs performed according to the process of FIG. 2. A first song 302 is on the left hand side and second song 304 is on the right hand side. In this example, a drum track 306, a voice track 308, and guitar track 310 are shown for each of the songs. The portion of the drum track 306 corresponding to first song shows high, consistently spaced peaks. Based on this information the drum is selected as the dominant instrument. The example in FIG. 3 also shows that the second song 304 has a higher tempo for the drum track. In particular, the peaks of the drum beats on the drum track 306 corresponding to the second song 304 are closer to together. Since the two songs have different tempos, the tempo needs to be changed during the crossfade. All the other tracks are silenced during this tempo change since the drums were selected as the dominant instrument.

Figure 4:
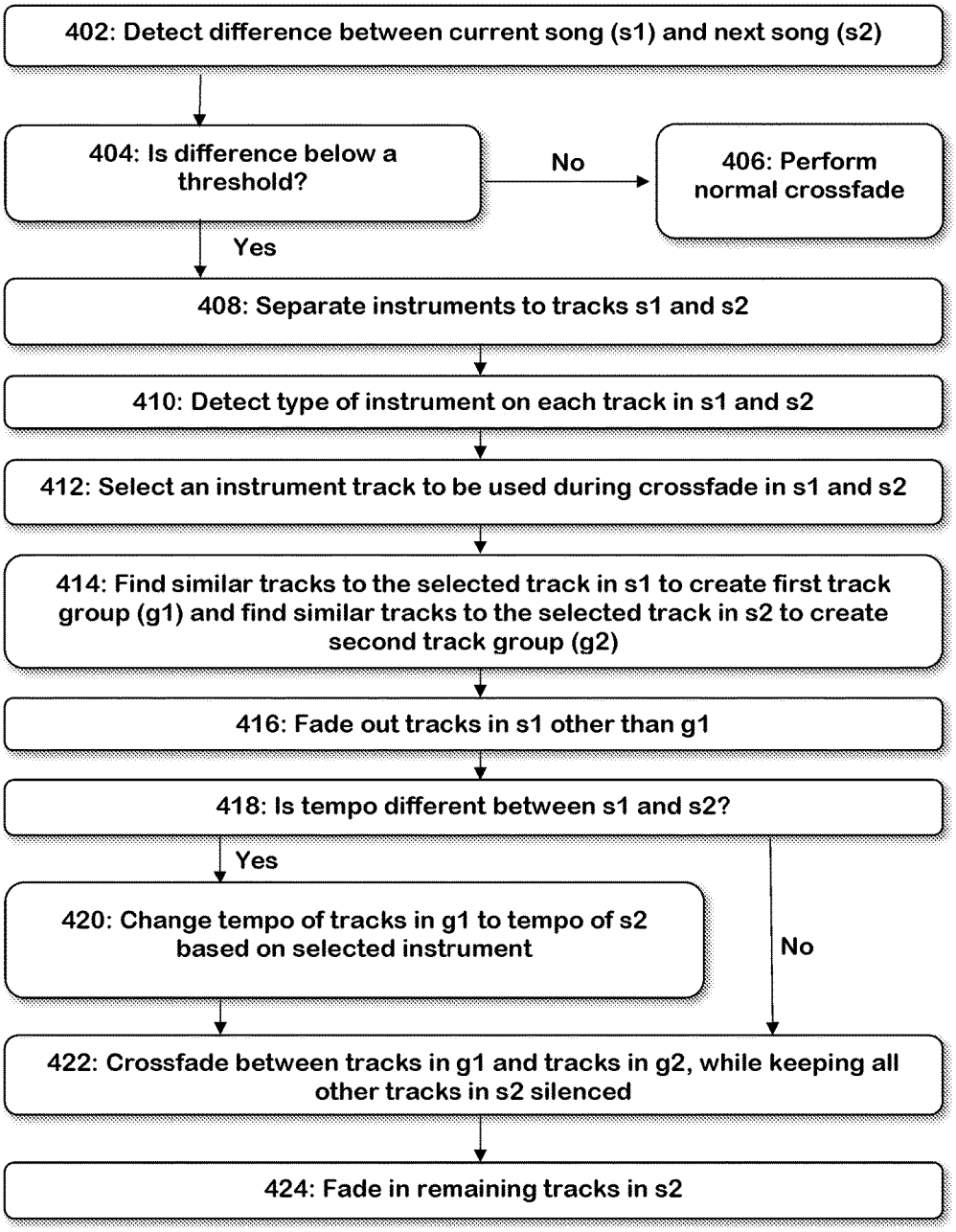
FIG. 4 is a process flow diagram for intelligent crossfading between two songs using groups of tracks having similar types of instruments to a selected instrument according to an exemplary embodiment.

Referring now to FIG. 4, this figure shows a process flow diagram for intelligent crossfading between two songs (s1, s2) according to another exemplary embodiment. Steps 402 to 410 are performed as described above with respect to steps 202-210 of FIG. 2. At step 412, an instrument track is selected to be used during the crossfade. For example, a harmonic instrument is good if there is a tempo difference between the songs; drums are good if there is a difference in musical harmonic structure e.g. a musical key change. At step 414, similar tracks to the selected track in s1 are found to create a first track group (g1); and similar tracks to the selected track in s2 are found to create a second track group (g2). The selected instrument may not have been separated well, sound from other instruments may leek to the selected instrument track. Typically, the instruments that leak most to the selected instrument track are those that are similar to the selected track. Therefore, in order to improve quality, tracks that are similar to the selected track are played together with the selected track. Similarity here can be measured using many different methods including: similar loudness, timbre, direction (or panning), zero-crossing rate, etc. At step 416, the instrument tracks in s1 are faded out other than the tracks in g1. At step 418, the tempo of s1 is compared to the tempo of s2. If the tempos are the same, then the process continues to step 422. If the tempos are different, then the tempo of the tracks in g1 are changed to match the tempo of s2 as shown at step 420. Similar to step 218 above, a tempo manipulation algorithm may be selected based on the type of the selected instrument. At step 422, crossfading is performed between tracks in g1 and tracks in g2 while keep all other tracks in s2 silenced. At step 424, the remaining tracks in s2 are faded in.

Finding similar tracks is described in document [9], for example. For example, similar tracks may found by calculating the cross-correlation between the dominant instrument from the first song and all instruments from the second song and choosing the one with highest correlation. Finding similar tracks may also be performed by, for example, calculating a number of features from the dominant instrument in the first song and from the instruments in the second song and choosing the instrument from the second song that has on average the most similar features. Typical features may include: timbre, tonality, zero-crossing rate, MFCC, LPC, fundamental frequency etc.

Figure 5:
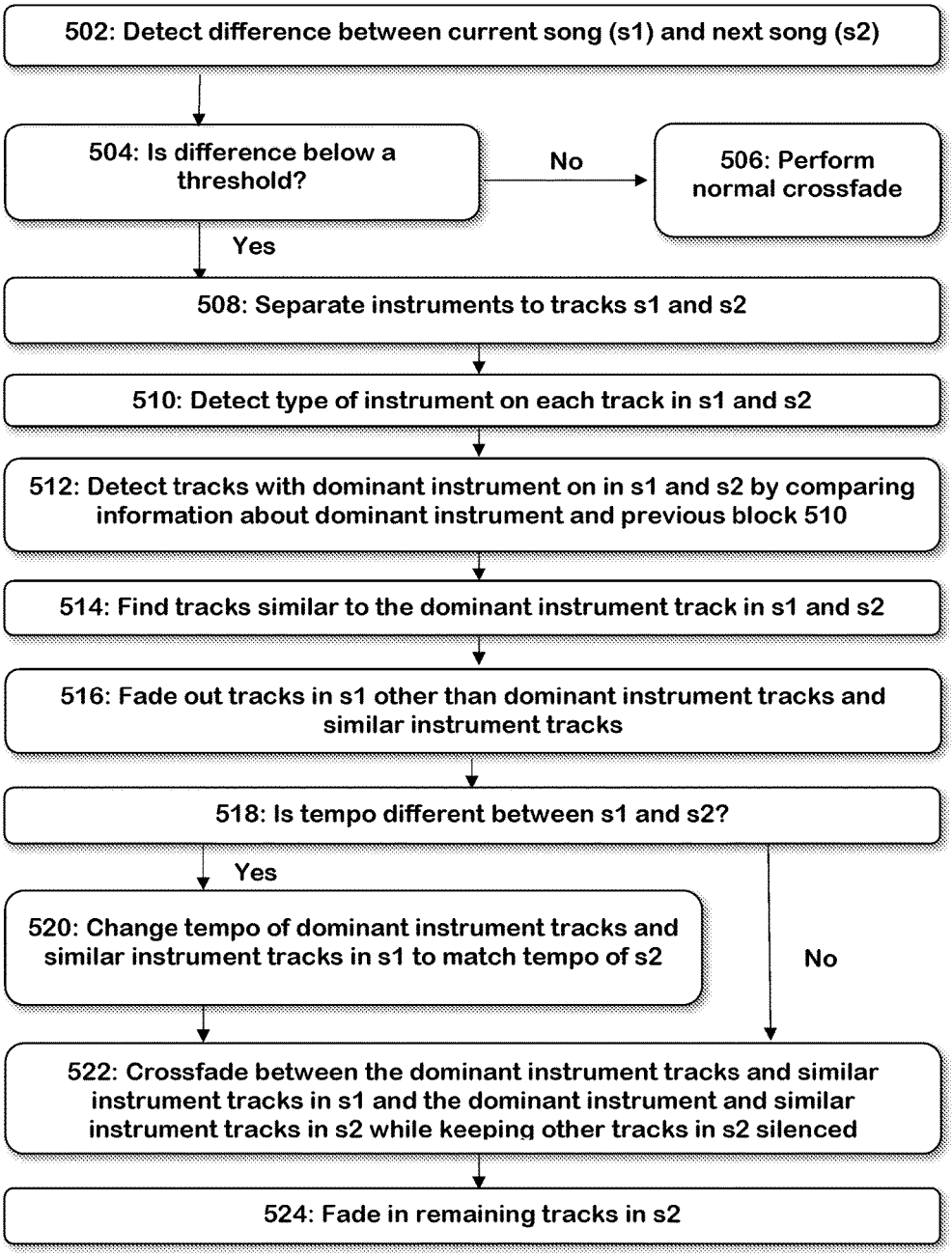
FIG. 5 is a process flow diagram for intelligent crossfading between two songs based on a dominant instrument and groups of tracks having similar types of instruments to the dominant instrument according to an exemplary embodiment.

Referring now to FIG. 5, this figure shows a process flow diagram for intelligent crossfading between two songs (s1, s2) according to another exemplary embodiment. Steps 502-512 are performed as described above with respect to steps 202-212 of FIG. 2. At step 514, similar tracks to the dominant instrument tracks in s1 are found; and similar tracks to the dominant tracks in s2 are found, e.g. as described above with respect to step 414. At step 516, the instrument tracks in s1 are faded out other than the dominant instrument tracks and the similar instrument tracks. At step 518, the tempo of s1 is compared to the tempo of s2. If the tempos are the same, then the process continues to step 522. If the tempos are different, then the tempo of the dominant instrument tracks and similar instrument tracks are changed to match the tempo of s2 as shown at step 520. Similar to step 218 above, a tempo manipulation algorithm may be selected based on the type of the selected instrument. At step 522, crossfading is performed between the dominant instrument tracks and similar instrument of s1, and the dominant instrument tracks and similar instrument tracks of s2, while keeping all other tracks in s2 silenced. At step 524, the remaining tracks in s2 are faded in.

In some embodiments the instrument tracks of the first song are faded out and silenced during the duration of the crossfade and one or more of the tracks in of the second song are silenced and faded in after the crossfade, however this is not required. For example, in some embodiments different cross-fading method may be selected for each instrument track such none of tracks are silenced during the fade-in and fade-out. Selecting the crossfading method may be based on the type of instrument. For example, if the instrument tracks to be crossfaded are drums, then a crossfading method optimized for drums may be selected, where if the instrument tracks are synthesizer tracks then a crossfading method optimized for synthesizers may be selected.

It should be understood that the current song (s1) and next song (s2) may have different instruments, and therefore may have different instrument tracks. According to some embodiments, only the instruments that exist in both songs are used for crossfading. For example, if the dominant instrument in the first song is not found in the second song then according to such embodiments the second or third most dominant instrument is used for cross-fading from the first song as long as it is available in the second song. In alternative embodiments, instruments are analyzed for similarity based on different features: tonality, zero-crossing rate, timbre, etc. and the most similar instrument in the second song (compared to the dominant instrument in the first song) is selected. Similarity can be measured by any suitable known method, such as: 1) calculating the cross-correlation between the dominant instrument from the first song and all instruments from the second song and choosing the instrument with highest correlation; or 2) calculating a number of features from the dominant instrument in the first song and from the instruments in the second song and choosing the instrument from the second song that has on average the most similar features. Typical features used in such cases include: timbre, tonality, zero-crossing rate, MFCC, LPC, fundamental frequency etc.

For example, assume s1 includes a piano, and it is determined that the piano is the dominant instrument in s1. Further assume s2 does not include in piano. According to some embodiments, a different instrument in s1 may be selected to perform the crossfade, such that the different instrument is also in s2. Alternatively, a similar instrument may be selected in s2 (e.g. a synthesizer) such that the crossfading is performed between the dominant instrument in s1 and a similar instrument in s2 (e.g. the synthesizer).

In some songs, the dominant instrument track may be a vocal track. If this is the case, additional processing may be required. Vocal tracks are difficult for crossfading because of the possibility of mixing lyrics and because human hearing is sensitive to all changes in speech/vocal signals. If the vocal track in the first song is dominant, according to some embodiments the second most dominant instrument track is selected for crossfading. If there is a clear need for using the vocal track for cross-fading (e.g. user preference or there are no other instrument tracks or the other instruments tracks are relatively much quieter) then a vocal track may be used. In such cases, crossfading of the vocal tracks may be performed, for example, by finding the ends of sentences or places where there are no clear lyrics (e.g. humming, singer is singing 'ooo-ooo-ooo' or the like) and the crossfading is performed between sentences or when there are no clear lyrics.

Vocals tracks are difficult because for natural crossfading, and the vocal tracks should be changed after a word or preferably after a sentence. Therefore, the vocal track can be analyzed for word or sentence boundaries (e.g. as describe in document [6]) and fade ins/outs can occur at these boundaries.

According to some embodiments, a first file (e.g. a first song) and a second file (e.g. second song) are separated into tracks as described above, and then it is determined which tracks are vocal tracks. Next, the vocal track of the first song is muted slightly before the end of the song. Slight muting the vocal track is easy as the vocal tracks have been separated from the other tracks. Next, a beat changer is used to change the beat of the first song to match the beat of the second song. According to some embodiments, a beat changer that also causes a pitch change is used. For example, a beat changer using resampling causes a lower pitch and lower tempo if a song is resampled to a higher sampling rate and the original sampling rate is used during play back; whereas a higher pitch and higher tempo is given if resampled to a lower sampling rate and the original sampling rate is used during play back. Beat changers which also cause pitch change work well as they do not cause the other artefacts even with large changes that other beat changers have. The problem with these type of beat changers is that they may sound funny with vocals, e.g., by causing an "Alvin and the chipmunks" effect. However, according to these embodiments the effect is not overly disturbing because the vocal track has been at least partially muted. Typically, gradually changing the beat sounds better than if the beat of the first song is abruptly changed to match the second song. The second song is then faded in with its vocal track muted, and finally the system unmutes the vocal track of the second song.

Non-pitch-changing beat changers have different problems, such as doubled beats, garbled lyrics and other annoying artefacts when the needed change is large for example. Vocals can sound funny and awkward when only the speed changes without changing the pitch. Thus, it can be seen that the typical problems associated with beat changers are reduced using according to these embodiments.

The crossfading described by the embodiments above may be automatically applied to all songs. Alternatively, some embodiments may include an option to detect the genre of two songs, and apply the crossfading based on the genre. For example, crossfading between classical music may not be desired, therefore, in some embodiments the crossfading is not performed when it is determined that the first song and/or the second song is a classical music. This could be determined, for example, based on metadata which provides the genre of the respective songs.

An example use case according to exemplary embodiments is when a user creates a music library with multiple songs (e.g. digital music files) in a music player for example. The music player may identify the dominant instruments in each song, and automatically crossfade across songs based on the identified dominant instruments, which means that some songs may start playing from the first time stamp of such dominant instrument. This type of implementation provides seamless crossfading from one song to another based on selected instruments. In some embodiments, the user may also configure settings in the music player which can decide which instrument to use for such crossfading.

Figure 6:
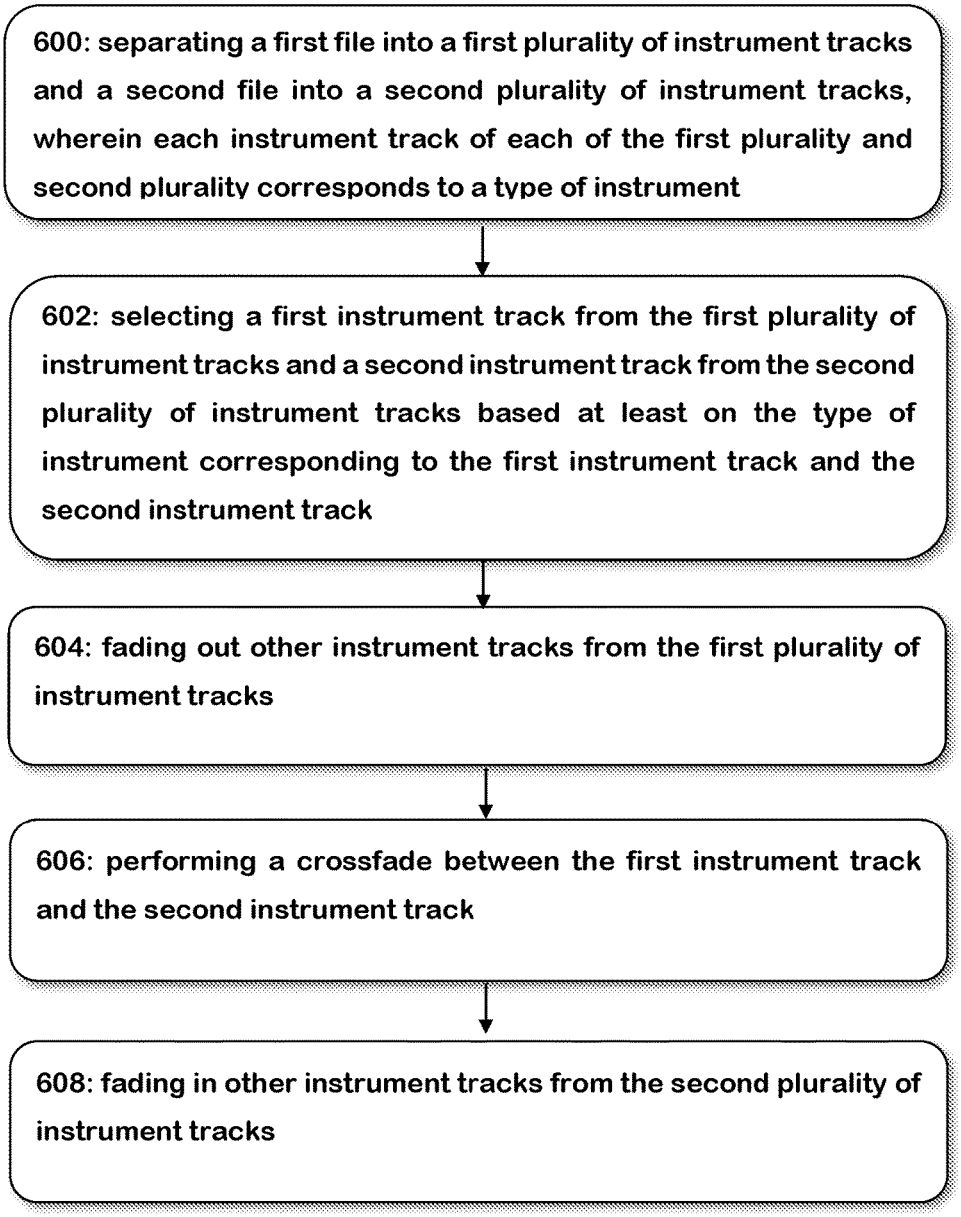
FIG. 6 is a logic flow diagram for intelligent crossfading with separated instrument tracks, and illustrates the operation of an exemplary method, a result of execution of computer program instructions embodied on a computer readable memory, functions performed by logic implemented in hardware, and/or interconnected means for performing functions in accordance with exemplary embodiments.

FIG. 6 is a logic flow diagram for intelligent crossfading with separated instrument tracks. This figure further illustrates the operation of an exemplary method, a result of execution of computer program instructions embodied on a computer readable memory, functions performed by logic implemented in hardware, and/or interconnected means for performing functions in accordance with exemplary embodiments. For instance, the audio module 108-1 and/or 108-2 may include multiples ones of the blocks in FIG. 6, where each included block is an interconnected means for performing the function in the block. The blocks in FIG. 6 are assumed to be performed by the apparatus 100, e.g., under control of the audio module 108-1 and/or 108-2 at least in part.

In one example embodiment, a method may include: separating a first file into a first plurality of instrument tracks and a second file into a second plurality of instrument tracks, wherein each instrument track of each of the first plurality and second plurality may correspond to a type of instrument as indicated by block 600; selecting a first instrument track from the first plurality of instrument tracks and a second instrument track from the second plurality of instrument tracks based at least on the type of instrument corresponding to the first instrument track and the second instrument track as indicated by block 602; fading out other instrument tracks from the first plurality of instrument tracks as indicated by block 604; performing a crossfade between the first instrument track and the second instrument track as indicated by block 606; and fading in other instrument tracks from the second plurality of instrument tracks as indicated by block 608.

The method may further include: determining a dominant instrument in the first plurality of instrument tracks and a corresponding instrument track in the second plurality of instrument tracks comprising the dominant instrument, wherein the selecting may include: selecting the dominant instrument track as the first instrument track and the corresponding instrument track as the second instrument track. If none of the instrument tracks in the second plurality of instrument tracks comprises the dominant instrument, the method may include at least one of: determining a different dominant instrument in the first plurality of instrument tracks, wherein each of the selected first instrument track and the selected second instrument track may include the different dominant instrument; and determining a similar instrument in the second plurality of instrument tracks as the dominant instrument, wherein the selected first instrument track may comprise the dominant instrument, and the selected second instrument track may comprise the similar instrument. The method may further include: creating a first group of instrument tracks by finding at least one further instrument track in the first plurality that is similar to the selected first instrument track; creating a second group of instrument tracks by finding at least one further instrument track in the second plurality that is similar to the selected second instrument track; and performing the crossfade between the first group of instrument tracks and the second group of instrument tracks. Finding similar instrument tracks may be based on comparing at least one of: loudness, timbre, direction, and zero-crossing rate. The method may further comprise: determining a difference in tempo between the first instrument track and the second instrument track; and adjusting, during the crossfade, the tempo of at least one of the first track and the second track based on the type of instrument. The fading out may include fading out each track in the first plurality of instrument tracks other than the selected first instrument track. The fading in may include fading in each track in the second plurality of instrument tracks other than the selected second instrument track. During at least a portion of the crossfade one or more instrument tracks from the first plurality of instrument tracks that are different from the selected first instrument track may be silenced. During at least a portion of the crossfade one or more instrument tracks from the second plurality of instrument tracks that are different from the selected second instrument track may be silenced. The separation may be based on at least one of: MPEG Spatial Audio Object Coding (SAOC) and blind single sound source separation (BSS).

In one example embodiment, an apparatus (e.g. apparatus 100 of FIG. 1) may comprise at least one processor; and at least one memory including computer program code, the at least one memory and the computer program code may be configured, with the at least one processor, to cause the apparatus to perform at least the following: separate a first file into a first plurality of instrument tracks and a second file into a second plurality of instrument tracks, wherein each instrument track of each of the first plurality and second plurality may correspond to a type of instrument; select a first instrument track from the first plurality of instrument tracks and a second instrument track from the second plurality of instrument tracks based at least on the type of instrument corresponding to the first instrument track and the second instrument track; fade out other instrument tracks from the first plurality of instrument tracks; perform a crossfade between the first instrument track and the second instrument track; and fade in other instrument tracks from the second plurality of instrument tracks.

The at least one memory and the computer program code may be configured, with the at least one processor, to cause the apparatus to: determine a dominant instrument in the first plurality of instrument tracks and a corresponding instrument track in the second plurality of instrument tracks comprising the dominant instrument, wherein the selection may include: selection of the dominant instrument track as the first instrument track and the corresponding instrument track as the second instrument track. If none of the instrument tracks in the second plurality of instrument tracks comprises the dominant instrument, the at least one memory and the computer program code may be configured, with the at least one processor, to cause the apparatus to: determine a different dominant instrument in the first plurality of instrument tracks, wherein each of the selected first instrument track and the selected second instrument track may include the different dominant instrument; and determine a similar instrument in the second plurality of instrument tracks as the dominant instrument, wherein the selected first instrument track may include the dominant instrument, and the selected second instrument track comprises the similar instrument. The at least one memory and the computer program code may be configured, with the at least one processor, to cause the apparatus to perform at least the following: create a first group of instrument tracks by finding at least one further instrument track in the first plurality that is similar to the selected first instrument track; create a second group of instrument tracks by finding at least one further instrument track in the second plurality that is similar to the selected second instrument track; and perform the crossfade between the first group of instrument tracks and the second group of instrument tracks. Finding similar instrument tracks may be based on comparing at least one of: loudness, timbre, direction, and zero-crossing rate. The at least one memory and the computer program code may be configured, with the at least one processor, to cause the apparatus to perform at least the following: determine a difference in tempo between the first instrument track and the second instrument track; and adjust, during the crossfade, the tempo of at least one of the first track and the second track. The adjustment of the tempo may include selecting a tempo manipulation algorithm based on the type of instrument. The fade out may include fading out each track in the first plurality of instrument tracks other than the selected first instrument track. The fade in may include fading in each track in the second plurality of instrument tracks other than the selected second instrument track. The separation may be based on at least one of: MPEG Spatial Audio Object Coding (SAOC) and blind single sound source separation (BSS). The at least one memory and the computer program code may be configured, with the at least one processor, to cause the apparatus to perform at least the following: create a third file comprising the crossfade, and store the third file in the memory for audio playback.

According to another aspect, a computer program product may include a non-transitory computer-readable storage medium having computer program code embodied thereon which when executed by an apparatus may cause the apparatus to perform: separating a first file into a first plurality of instrument tracks and a second file into a second plurality of instrument tracks, wherein each of the respective instrument tracks correspond to a type of instrument; selecting a first instrument track from the first plurality of instrument tracks and a second instrument corresponding to the first instrument track and the second instrument track; fading out other instrument tracks from the first plurality of instrument tracks; performing a crossfade between the first instrument track and the second instrument track; and fading in other instrument tracks from the second plurality of instrument tracks.

In one example embodiment, an apparatus may comprise: means for separating a first file into a first plurality of instrument tracks and a second file into a second plurality of instrument tracks, wherein each of the respective instrument tracks correspond to a type of instrument; means for selecting a first instrument track from the first plurality of instrument tracks and a second instrument corresponding to the first instrument track and the second instrument track; means for fading out other instrument tracks from the first plurality of instrument tracks; means for performing a crossfade between the first instrument track and the second instrument track; and means for fading in other instrument tracks from the second plurality of instrument tracks.

Without in any way limiting the scope, interpretation, or application of the claims appearing below, a technical effect of one or more of the example embodiments disclosed herein provide an automated DJ like experience for crossfading between songs.

Embodiments herein may be implemented in software (executed by one or more processors), hardware (e.g., an application specific integrated circuit), or a combination of software and hardware. In an example embodiment, the software (e.g., application logic, an instruction set) is maintained on any one of various conventional computer-readable media. In the context of this document, a "computer-readable medium" may be any media or means that can contain, store, communicate, propagate or transport the instructions for use by or in connection with an instruction execution system, apparatus, or device, such as a computer, with one example of a computer described and depicted, e.g., in FIG. 1. A computer-readable medium may comprise a computer-readable storage medium (e.g., memory 104 or other device) that may be any media or means that can contain, store, and/or transport the instructions for use by or in connection with an instruction execution system, apparatus, or device, such as a computer. A computer-readable storage medium does not comprise propagating signals.

Any combination of one or more computer readable medium(s) may be utilized as the memory. The computer readable medium may be a computer readable signal medium or a non-transitory computer readable storage medium. A non-transitory computer readable storage medium does not include propagating signals and may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

If desired, the different functions discussed herein may be performed in a different order and/or concurrently with each other. Furthermore, if desired, one or more of the above-described functions may be optional or may be combined.

Although various aspects of the invention are set out in the independent claims, other aspects of the invention comprise other combinations of features from the described embodiments and/or the dependent claims with the features of the independent claims, and not solely the combinations explicitly set out in the claims.

It is also noted herein that while the above describes example embodiments of the invention, these descriptions should not be viewed in a limiting sense. Rather, there are several variations and modifications which may be made without departing from the scope of the present invention as defined in the appended claims.

What is claimed is:

1. A method comprising:

selecting at least one first audio track from a first plurality of audio tracks and at least one second audio track from a second plurality of audio tracks based at least on a similarity of the at least one first audio track and the at least one second audio track, wherein the first plurality of audio tracks comprise audio tracks separated from a first file and the second plurality of audio tracks comprise audio tracks separated from a second file;

fading out at least one other audio track from the first plurality of audio tracks;

performing a crossfade between the at least one first audio track and the at least one second audio track; and fading in at least one other audio track from the second plurality of audio tracks.

2. The method of claim 1, further comprising:

determining a dominant audio source in at least one of the first plurality of audio tracks, and determining whether at least one corresponding audio track in the second plurality of audio tracks comprises the dominant audio source, wherein the selecting comprises:

selecting the at least one first audio track comprising the dominant audio source as the at least one first audio track, and in response to determining that the at least one corresponding audio track in the second plurality of audio tracks comprises the dominant audio source, selecting the at least one corresponding audio track as the at least one second audio track.

3. The method of claim 2, wherein, in response to determining that none of the audio tracks in the second plurality of audio tracks comprises the dominant audio source, the method further comprises at least one of:

determining a different dominant audio source in the first plurality of audio tracks, wherein each of the selected at last one first audio track and the selected at least one second audio track comprises the different dominant audio source; or determining a similar dominant audio source in the second plurality of audio tracks as the dominant audio source, wherein the selected at least one first audio track comprises the dominant audio source, and the selected at least one second audio track comprises the similar dominant audio source.

4. The method of claim 1, wherein the method further comprises:

creating a first group of audio tracks comprising finding at least one further audio track in the first plurality of audio tracks that is similar to the selected at least one first audio track;

creating a second group of audio tracks comprising finding at least one further audio track in the second plurality of audio tracks that is similar to the at least one selected second audio track; and performing the crossfade between the first group of audio tracks and the second group of audio tracks.

5. The method of claim 4, wherein finding similar audio tracks is based on comparing at least one of: loudness, timbre, direction, or zero-crossing rate.

6. The method of claim 1, further comprising:

determining a difference in tempo between the at least one first audio track and the at least one second audio track; and adjusting, during the crossfade, the tempo of at least one of the at least one first audio track and the at least one second audio track.

7. The method of claim 1, wherein at least one of:

the fading out comprises fading out each audio track in the first plurality of audio tracks other than the selected at least one first audio track; or the fading in comprises fading in each audio track in the second plurality of audio tracks other than the selected at least one second audio track.

8. The method of claim 1, wherein, during at least a portion of the crossfade, at least one of:

one or more audio tracks from the first plurality of audio tracks that are different from the selected at least one first audio track are silenced; or one or more audio tracks from the second plurality of audio tracks that are different from the selected at least one second audio track are silenced.

9. The method of claim 1, wherein the method further comprises separating the first plurality of audio tracks from the first file and the second plurality of audio tracks from the second file based on at least one of: MPEG Spatial Audio Object Coding or blind single sound source separation.

10. The method of claim 1, further comprising:

creating a third file comprising the crossfade, and storing the third file in a memory for audio playback.

11. An apparatus, comprising:

at least one processor; and at least one non-transitory memory comprising computer program code, the at least one memory and the computer program code configured, with the at least one processor, to cause the apparatus to at least:

select at least one first audio track from a first plurality of audio tracks and at least one second audio track from a second plurality of audio tracks based at least on a similarity of the at least one first audio track and the at least one second audio track, wherein the first plurality of audio tracks comprise audio tracks separated from a first file and the second plurality of audio tracks comprise audio tracks separated from a second file;

fade out at least one other audio track from the first plurality of audio tracks;

perform a crossfade between the at least one first audio track and the at least one second audio track; and fade in at least one other audio track from the second plurality of audio tracks.

12. The apparatus of claim 11, wherein the at least one memory and the computer program code are configured, with the at least one processor, to cause the apparatus to:

determine a dominant audio source in at least one of the first plurality of audio tracks and determine whether at least one corresponding audio track in the second plurality of audio tracks comprises the dominant audio source, wherein the selection comprises:

selection of the at least one first audio track comprising the dominant audio source as the at least one first audio track, and in response to determination that the at least one corresponding audio track in the second plurality of audio tracks comprises the dominant audio source, select the at least one corresponding audio track as the at least one second audio track.

13. The apparatus of claim 12, wherein, in response to determining that none of the audio tracks in the second plurality of audio tracks comprises the dominant audio source, the at least one memory and the computer program code are configured, with the at least one processor, to cause the apparatus to at least one of:

determine a different dominant audio source in the first plurality of audio tracks, wherein each of the selected at least one first audio track and the selected at least one second audio track comprises the different dominant audio source; or determine a similar dominant audio source in the second plurality of audio tracks as the dominant audio source, wherein the selected at least one first audio track comprises the dominant audio source, and the selected at least one second audio track comprises the similar dominant audio source.

14. The apparatus of claim 11, wherein the at least one memory and the computer program code are configured, with the at least one processor, to cause the apparatus to perform at least the following:

create a first group of audio tracks comprising finding at least one further audio track in the first plurality of audio tracks that is similar to the selected at least one first audio track;

create a second group of audio tracks comprising finding at least one further audio track in the second plurality of audio tracks that is similar to the selected at least one second audio track; and perform the crossfade between the first group of audio tracks and the second group of audio tracks.

15. The apparatus of claim 14, wherein finding similar audio tracks is based on comparing at least one of: loudness, timbre, direction, or zero-crossing rate.

16. The apparatus of claim 11, wherein the at least one memory and the computer program code are configured, with the at least one processor, to cause the apparatus to perform at least the following:

determine a difference in tempo between the at least one first audio track and the at least one second audio track; and adjust, during the crossfade, the tempo of at least one of the at least one first audio track and the at least one second audio track.

17. The apparatus of claim 11, wherein at least one of:

the fade out comprises fading out each audio track in the first plurality of audio tracks other than the selected at least one first audio track; or the fade in comprises fading in each audio track in the second plurality of audio tracks other than the selected at least one second audio track.

18. The apparatus of claim 11, wherein the at least one memory and the computer program code are configured, with the at least one processor, to cause the apparatus to perform at least the following:

separating the first plurality of audio tracks from the first file and the second plurality of audio tracks from the second file based on at least one of: MPEG Spatial Audio Object Coding or blind single sound source separation.

19. The apparatus of claim 11, wherein the at least one memory and the computer program code are configured, with the at least one processor, to cause the apparatus to perform at least the following:

create a third file comprising the crossfade, and store the third file in the memory for audio playback.

20. A computer program product comprising a non-transitory computer-readable storage medium comprising computer program code embodied thereon which when executed by an apparatus causes the apparatus to perform:

selecting at least one first audio track from a first plurality of audio tracks and at least one second audio track from a second plurality of audio tracks based at least on a similarity of the at least one first audio track and the at least one second audio track, wherein the first plurality of audio tracks comprise audio tracks separated from a first file and the second plurality of audio tracks comprise audio tracks separated from a second file;

fading out at least one other audio track from the first plurality of audio tracks;

performing a crossfade between the at least one first audio track and the at least one second audio track; and fading in at least one other audio track from the second plurality of audio tracks.

* * * * *